US005168828A

United States Patent [19]

Smyly, Sr.

[11] Patent Number: 5,168,828

[45] Date of Patent: Dec. 8, 1992

[54] LOFTY FLAG SHELTERING HOUSE

[76] Inventor: George M. Smyly, Sr., 1903-B Carlton St., North Charleston, S.C. 29405

[21] Appl. No.: 777,783

[22] Filed: Oct. 16, 1991

[51] Int. Cl.[5] ..... G09F 17/00

[52] U.S. Cl. ..... 116/173

[58] Field of Search ..... 116/173, 174, 175, 281, 116/282, 283, 306, 307, DIG. 4; 40/601

[56] References Cited

U.S. PATENT DOCUMENTS

| | | | |
|---|---|---|---|
| 556,614 | 3/1896 | Cabell | 116/175 |
| 765,427 | 7/1904 | Herrick | 116/174 |
| 1,359,818 | 11/1920 | Marr | 116/173 |
| 3,417,732 | 12/1968 | Platt, Jr. | 116/173 |
| 3,923,001 | 12/1975 | Murdock | 116/173 |
| 3,996,882 | 12/1976 | Martin et al. | 116/174 |
| 4,103,642 | 8/1978 | Swenson | 116/174 |
| 4,332,210 | 6/1982 | Lambert | 116/173 |
| 4,583,482 | 4/1986 | Smith | 116/173 X |
| 4,603,652 | 8/1986 | Thibault et al. | 116/174 |
| 4,972,794 | 11/1990 | Smyly, Sr. | 116/173 |

FOREIGN PATENT DOCUMENTS

| | | | |
|---|---|---|---|
| 2457945 | 6/1976 | Fed. Rep. of Germany | 116/174 |
| 3737655 | 5/1989 | Fed. Rep. of Germany | 116/173 |
| 2596185 | 9/1987 | France | 116/173 |
| 0224793 | 9/1989 | Japan | 116/173 |
| 1323841 | 7/1973 | United Kingdom | 116/173 |

OTHER PUBLICATIONS

Automatic Flagpole Co., "Flagpole of Distinction" Mar. 1985, brochure.

*Primary Examiner*—William A. Cuchlinski, Jr.
*Assistant Examiner*—John L. Beres

[57] ABSTRACT

The Flag is attached to an ornamental halyard tube which is raised and lowered along a weather capped flagpole. A spring disposed within the tube limits the displacement of a ring which encircles a flag furling cord. A line for hoisting and lowering an appealing flag sheltering house along the flagpole is attached to the ring. Initial pulling upon the free end of the line displaces the ring furling the Flag. Continued pulling upon the line hoist the housing, the furled flag being received into an opening at the top of the housing, the housing finally mating with the cap of the weather capped flagpole. A second flag may be displayed by attaching the top corner thereof to the line and the bottom corner thereof to a weight which encircles the line.

12 Claims, 7 Drawing Sheets

LOFTY FLAG SHELTERING HOUSE

REFERENCE TO RELATED APPLICATIONS

This application will reveal a new apparatus which is comparable to my FLAGSTAFF WITH PROTECTIVE HOUSING, U.S. Pat. No. 4,972,794, issued Nov. 27, 1990.

BACKGROUND OF THE INVENTION

1. Field of the Invention

The present invention relates to protectively housing and displaying a flag upon a flagpole. More specifically, the present invention relates to an apparatus which introduces an all new halyard tube, alongside which the flag is removably attached, and which will loftily shelter and display the flag upon a flagpole.

2. Prior Art

My FLAGSTAFF WITH PROTECTIVE HOUSING, U.S. Pat. No. 4,972,794, issued Nov. 27, 1990, features an apparatus which will protectively house and display a flag upon a flagstaff. A halyard for hoisting and lowering the flag alongside the flagstaff is not combined with this particular apparatus and therefore the apparatus can neither display the flag at half-staff nor provide a simple means for removably attaching the flag to the flagstaff.

The apparatuses of Herrick, U.S. Pat. No. 765,427, (Jul. 19, 1904), Platt, Jr., U.S. Pat. No. 3,417,732, (Dec. 24, 1968), McInnin, U.S. Pat. No. 3,675,616, (Jul. 11, 1972), Feng, U.S. Pat. No. 4,800,834, (Jan. 31, 1989), Martin and Miller, U.S. Pat. No. 3,996,882, (Dec. 14, 1976), Lambert, U.S. Pat. No. 4,332,210, (Jun. 1, 1982), and Swensen, U.S. Pat. No. 4,103,642 (Aug. 1, 1978) are examples of commendable solutions to the problems of storing, protecting, and displaying a flag.

However, no apparatus is known which features the mentioned halyard tube and a lofty flag sheltering house in combination with a weather capped flagpole, the apparatus having a halyard attached to the halyard tube so that the halyard tube can be hoisted and lowered alongside the flagpole and the Flag, which is now removably attached to the halyard tube, displayed at half-staff during times of national mourning.

Further, the apparatus is capable of loftily sheltering and displaying more than one flag upon a flagpole and a similar apparatus having these capabilities does not exist.

Yet further, no comparable apparatus exist which is easier to construct, less complicated, and lower in cost than the hereinafter described apparatus.

SUMMARY OF THE INVENTION

The principal object of the present invention is to provide an apparatus which will shelter and honorably display the Flag of the United States of America.

Another object of the present invention is to provide an apparatus which will honorably display the Flag of the United States of America at half-staff during times of national mourning.

Another object of the present invention is to provide an apparatus which will shelter and display more than one flag upon a flagpole.

Yet, another object of the present invention is to provide an apparatus requiring only one person to operate the same.

Further, an object of the present invention is to provide an apparatus which features the all new halyard tube.

Yet further, an object of the present invention is to provide an apparatus which can be combined with existing conventional flagpoles.

Yet, an even further object of the present invention is to provide an apparatus which can be conveniently managed even when the apparatus is purposely located at a somewhat inaccessible site.

Finally an object of the present invention is to provide an apparatus for sheltering and displaying the Flag of the United States of America which will not violate the Flag Code as established by the United States Congress.

Briefly, the foregoing objects are accomplished by removably attaching the Flag to a halyard tube which is hoisted, via a halyard, alongside a flagpole. The tube has a spring retracted ring encircling a flag furling cord, the cord extending between the midpoint of the lower edge of the Flag and the bottom of the halyard tube. A line for hoisting and lowering a flag housing along the flagpole is attached to the ring. Initial pulling upon the line displaces the ring furling the Flag. Continued pulling upon the line hoist the housing, the furled flag being received into an opening at the top of the housing, the housing finally mating with a weather cap disposed atop the flagpole.

A second flag can be combined with the apparatus by attaching an upper portion of its side edge to the line proximate the ring and by attaching a lower portion of its side edge to a weight which encircles the line.

BRIEF DESCRIPTION OF THE DRAWINGS

My invention, the preferred mode of use and further objects and advantages thereof, will be best understood by referring to the following detailed description when read in conjunction with the accompanying drawings, wherein like reference characters refer to like parts and wherein.

DESCRIPTION OF THE PREFERRED EMBODIMENT OF THE INVENTION

In this first sentence and paragraph of the detailed description I wish to say that the hereinafter described halyard tube is the point of novelty of the invention and the "grand key" to the invention.

Hereinafter, the term flagpole means any suitable flagstaff, pole, staff, or mast of a vessel, alongside which flags are hoisted to the raised position.

Figure 26:
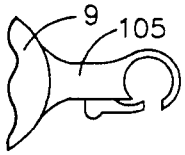
FIG. 26 depicts a plane partial view showing a type snap hook attached to the halyard tube.

Referring now to the drawings, FIGS. 1, 7, 8 and 14 show the halyard tube 9 having the Flag 18 removably attached to the front thereof. The snap hooks 11,11', which are clipped through openings 13,13' provided with the Flag, are preferably similar to the snap hook 105 depicted in FIG. 26.

Figure 7:
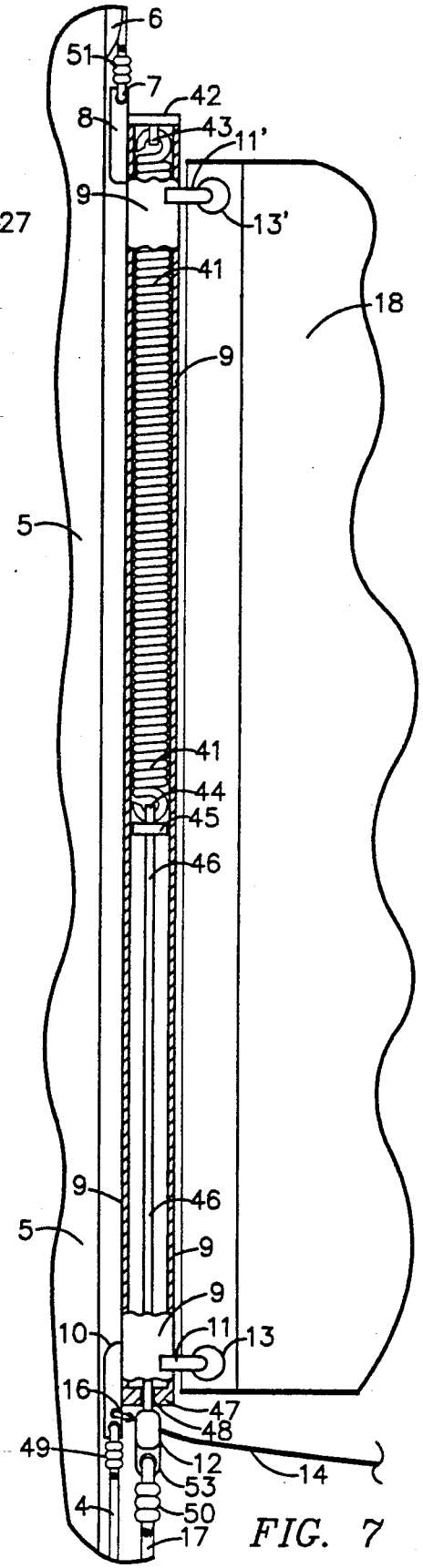
FIG. 7 depicts an enlarged partial cut-away sectional front view of the halyard tube.
Figure 9:
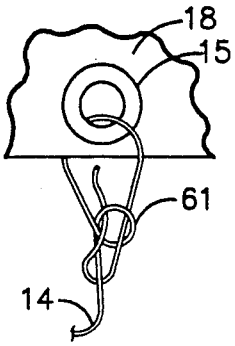
FIG. 9 depicts an enlarged partial front view of a method for attaching an end of the furling cord to the midpoint of the lower edge of the Flag.

A flag furling cord 14 is attached to the Flag, and, as shown in FIG. 9, a preferred Bowline knot 61 is employed to tie an end length of the cord 14 to the Flag such that the cord 14 is attached to the Flag at a location which is proximate the midpoint of the lower edge of the Flag. If desired, the cord can be sewn to a flag. A diminutive opening 15 through the Flag provides a tie point for the cord. As best shown in FIG. 7, the other end of the furling cord 14 is attached to a clip 16 which in turn is removably clipped onto a tab 10, the tab 10 being affixed to the back of the halyard tube such that it is disposed proximate the bottom of the halyard tube. As shown, the cord 14 is essentially attached to the halyard tube 9 proximate the bottom of the halyard tube 9, the cord extending from the midpoint of the lower edge of the Flag to a tab member of the halyard tube. Basically, the cord extends from the flag to the halyard tube.

Preferably, the main body of the halyard tube 9 is an elongate corrosion resistant hollow metal tube, the tube being basically similar to a conventional circular pipe. Preferably, the length of the tube slightly exceeds the width (hoist) of the leading edge of the Flag, the leading edge of the Flag being that edge of the Flag which borders the halyard tube.

As best shown in FIG. 7, a halyard 7 for hoisting and lowering the halyard tube 9 alongside the flag pole is attached to the halyard tube. A compression type crimp 51 secures an end length of the halyard within an aperture arranged through the tab 8, the tab 8 being affixed to the back of the halyard tube such that it is disposed proximate the top of the halyard tube 9.

A secondary halyard 4 is shown depending from the halyard tube. A compression type crimp 49 secures an end length of the secondary halyard 4 within an aperture arranged through the previously described tab 10. Hereinafter, it will become apparent that the secondary halyard 4 is an auxiliary halyard, and, although useful, it may be excluded from the invention.

Figure 19:
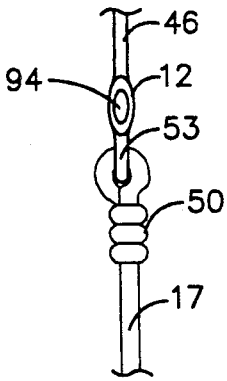
FIG. 19 depicts an enlarged plane partial side view of the housing line attached to a tab member of the furling cord ring.

A helical tension spring 41 and link stop 45 are disposed within the hollow of the halyard tube 9. The upper hook formed end of the spring 41 is hooked onto a depending tab member 43 of a halyard tube cover plate 42 and the lower hook formed end of the spring is hooked onto an upward protruding tab member 44 of the link stop 45. Basically, the spring 41 is attached to the link stop 45 and the halyard tube cover plate 42. An elongated link 46 having a preferred square cross section depends from the link stop 45. The link 46 is slidingly disposed through a square aperture 48 arranged through a bottom plate member 47 of the halyard tube 9 such that the link cannot rotate relative to the halyard tube. A displaceable spring retracted ring 12 depends from the bottom of the link 46 and is disposed below the halyard tube. The ring 12 is a member of the link 46, and, therefore, it cannot rotate relative to the halyard tube. A preferred elliptical shaped aperture 94 (FIG. 19) for receiving the flag furling cord 14 is arranged through the ring 12, the ring 12 encircling the flag furling cord 14. Surface areas of the ring are smooth and polished to prevent fraying of the flag furling cord.

Figure 8:
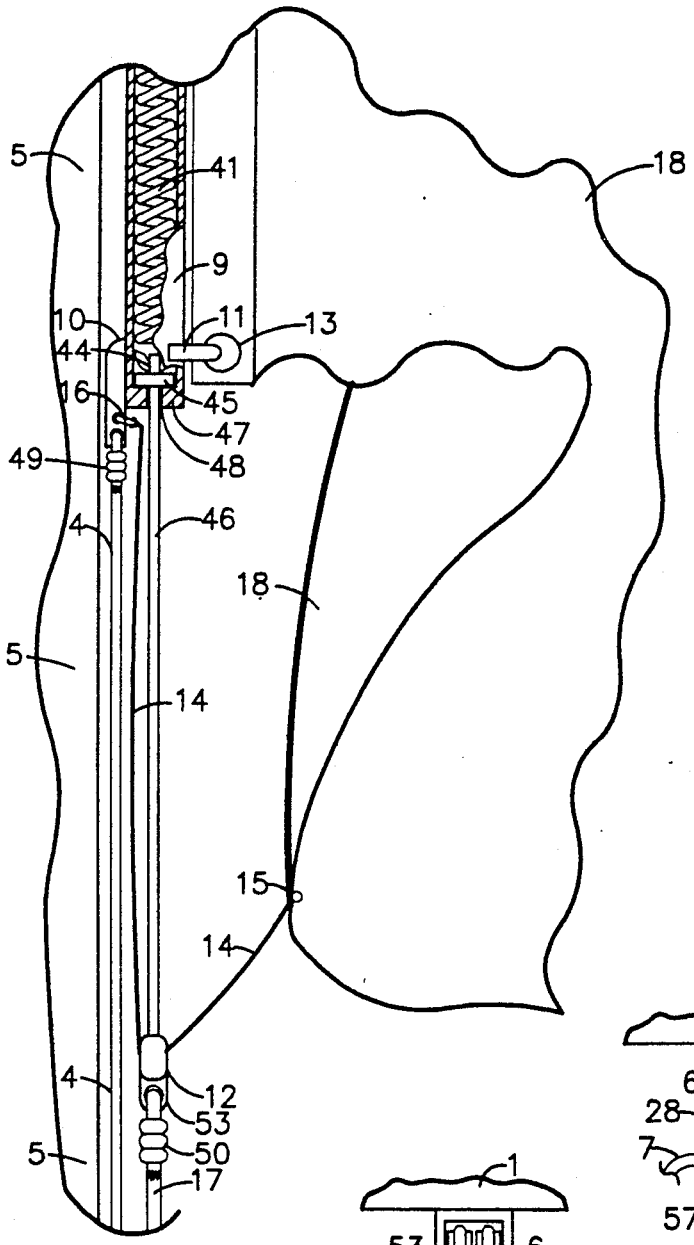
FIG. 8 depicts a view similar to FIG. 7 wherein furling of the Flag is shown.

Viewing FIG. 8, it is shown that the displacement of the displaceable spring retracted ring 12 furls the Flag. The link stop 45 bottoms out within the halyard tube as the spring 41 approaches its limited stretching span within the halyard tube, or, in other words, the link stop 45 bottoms out within the halyard tube when the spring 41 is sufficiently stretched and the link stop 45 comes into contact with the bottom plate member 47 of the halyard tube. The spring 41, having the limited stretching span within the halyard tube, essentially limits the displacement of the ring. As shown, the limited displacement of the ring prevents undue tension upon the flag furling cord. Basically, the spring 41, link stop 45, and the link 46 provide a spring means disposed within the halyard tube for retracting the ring 12 and limiting the displacement of the ring 12.

A flag housing hoisting and lowering line 17, or line means 17, for hoisting and lowering a hereinafter described flag housing 22, or flag housing means 22, for sheltering the Flag has an end length thereof attached to the ring 12. A compression type crimp 50 secures an end length of the line means 17 within an aperture arranged through a depending tab member 53 of the ring 12.

Compression type crimps are preferred because they assure that the halyard and line are safely secured to the tabs. Hereinafter, it will become apparent that the halyard tube must safely support the weight of the mentioned flag housing means. Obviously, conventional snap hooks can be used to attach the halyards and the line to the tabs.

As shown in many of the views, the preferred flagpole is a corrosion resistant, rigid, elongated, hollow, cylindrical metal tube and the flag housing means 22 is an elongated, partially hollow cylinder having openings at the top and bottom thereof. Viewing FIGS. 1 and 3, two vertically spaced apart somewhat donut shaped plates 24,25 are inserted within the opening at the bottom of the housing means 22, the plates having vertically aligned center holes 31,31' arranged therethrough. Bolts 27,27' are inserted through housing drill holes and screw into threaded receiving holes provided with the plates 24,25. The flagpole extends through the housing means 22 and the center holes 31,31' such that the housing means 22 surroundingly envelopes a length of the flagpole 5 and such that the housing means 22 and the flagpole are concentric about a common axis. The housing means is movable, or slidable, upward and downward along the flagpole.

Figure 20:
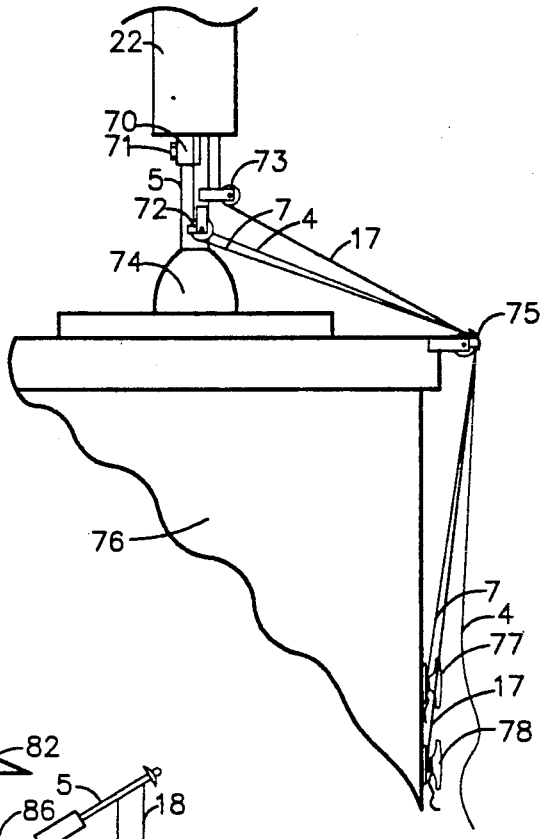
FIG. 20 depicts a plane partial front view of the invention mounted atop a building.
Figure 21:
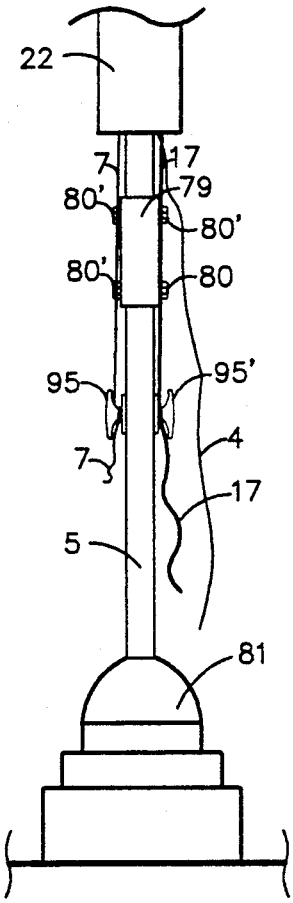
FIG. 21 depicts a view similar to FIG. 20 showing the invention mounted at ground level.

FIGS. 20 and 21 show two types of housing stops 70, 79 bolted 71, 80, 80' to the flagpole 5, the stop 70 partially surrounding the flagpole and the stop 79 encircling the flagpole. The housing means comes to rest upon the stops 70,79 when it is lowered along the flagpole.

Figure 1:
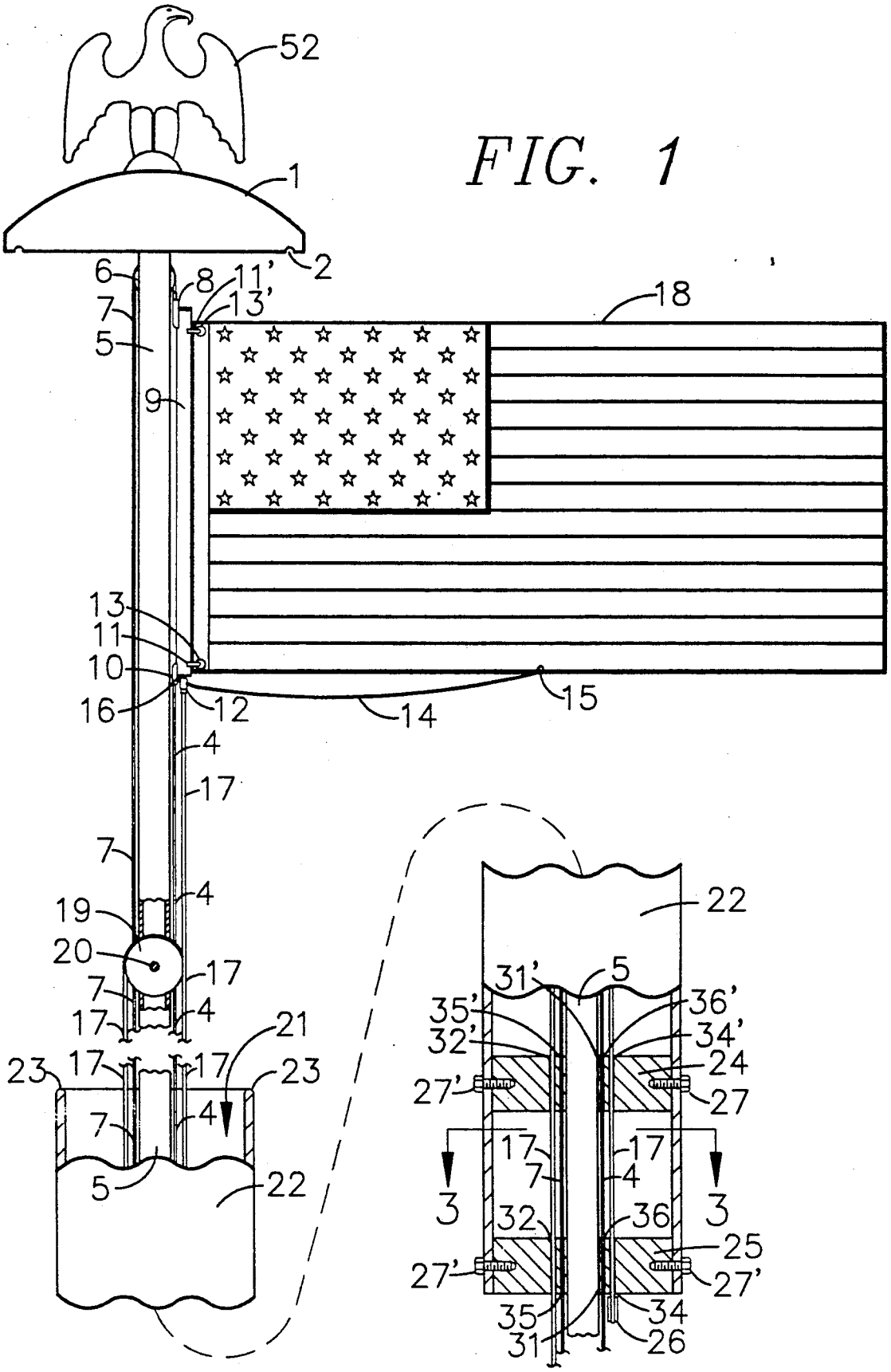
FIG. 1 depicts a plane partial fragmentary cut-away continuing sectional front view of the invention.
Figure 4:
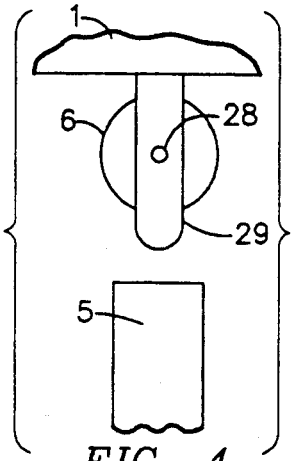
FIG. 4 depicts a partial front view of a weather cap supporting a halyard sheave.
Figure 5:
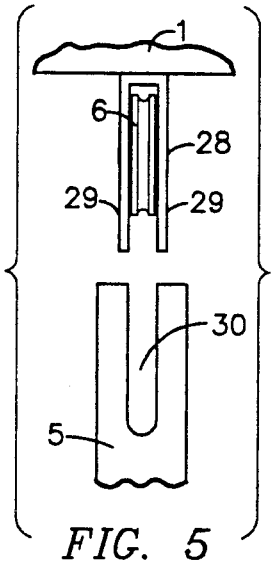
FIG. 5 depicts a side view of FIG. 4, showing that the flagpole has vertically arranged slits at the top open end thereof.

Viewing FIGS. 1, 4 and 5, a flag housing weather cap 1 is shown disposed atop the flagpole 5. If desired, an emblem 52 is mounted atop the cap. A drip shield groove 2 is provided around a circular shaped bottom surface area of the cap 1. A sheave 6 support frame 29 depends from the center of the bottom surface area of the cap, the frame 29 having a pin 28 mounted halyard sheave 6 disposed interposed between the side walls thereof. Portions of the outer periphery of the halyard sheave 6 protrude from within vertical opposing slits 30 arranged through an end length of the top of the flagpole 5, the frame 29 being insertable and inserted into the top opening of the now weather capped flagpole.

Figure 2:
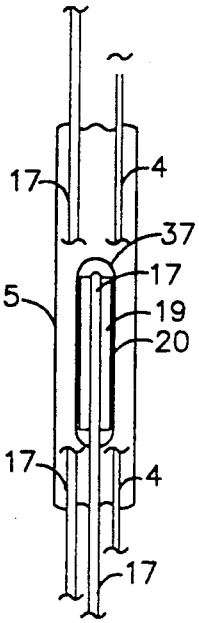
FIG. 2 depicts a plane partial side view of a flagpole having a line sheave mounted within the flagpole.

Viewing FIGS. 1 and 2, a pin 20 mounted housing line sheave 19 is shown disposed within the flagpole 5 such that portions of the outer periphery of the line sheave 19 protrude from within vertical opposing slots 37 arranged through the flagpole 5.

Figure 3:
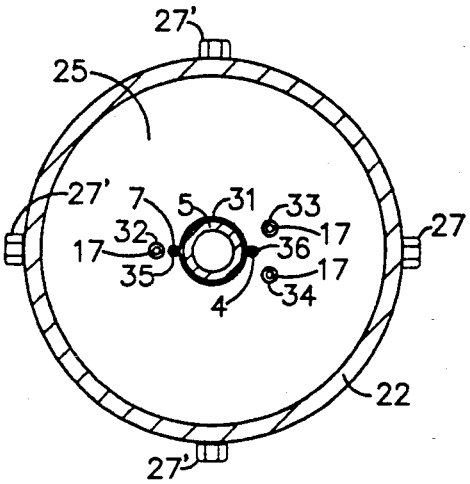
FIG. 3 depicts an enlarged top sectional view taken along the line 3—3 of FIG. 1.

Viewing FIG. 1 with a quick glance a FIG. 3, the halyard 7 is shown training about the halyard sheave 6 and extending through the aligned plate apertures 32,32'. The second halyard 4 extends directly through the plate apertures 36,36'.

Figure 15:
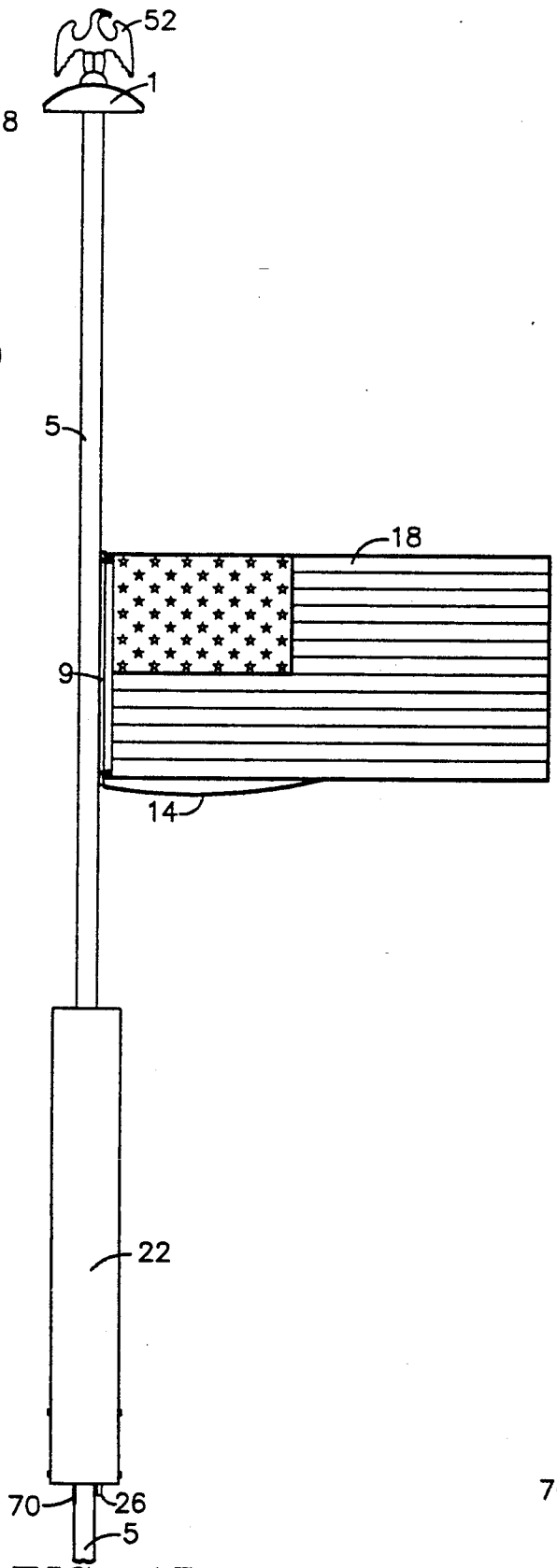
FIG. 15 depicts a view similar to FIG. 14 showing the Flag at half-staff.

At this point in the description, with a quick glance at FIGS. 15, 20 and 21, it is easy to see that the halyard tube 9 can be hoisted and lowered alongside the flagpole so that the Flag can be displayed at half-staff during times of national mourning.

Figure 6:
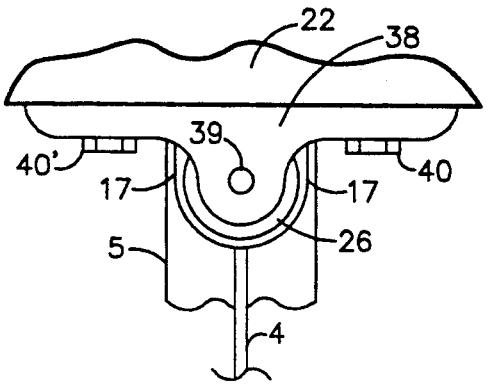
FIG. 6 depicts an enlarged plane partial side view of a sheave supporting frame mounted to the bottom of the housing.

Viewing FIGS. 1 and 6, a pin 39 mounted housing sheave 26 is shown supported by a frame 38 which is bolted 40,40' onto the plate 25. FIGS. 1, 2, 3 and 6 show the line means 17 training about the sheaves 19,26 with the apertures 33,33',32,32' providing spaces for the line means 17 to extend through the plates 24,25.

Figure 12:
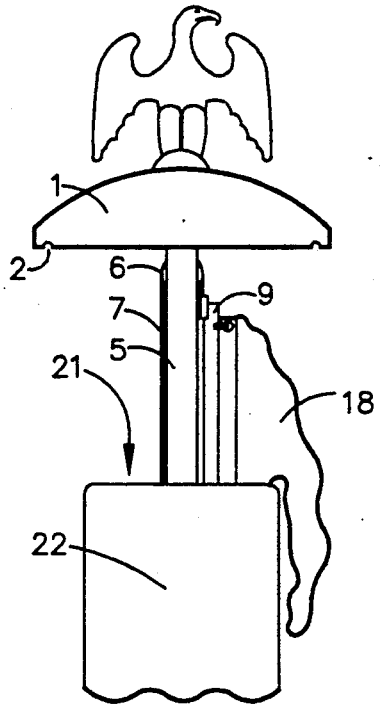
FIG. 12 depicts a plane partial front view of the housing enveloping a furled flag.
Figure 16:
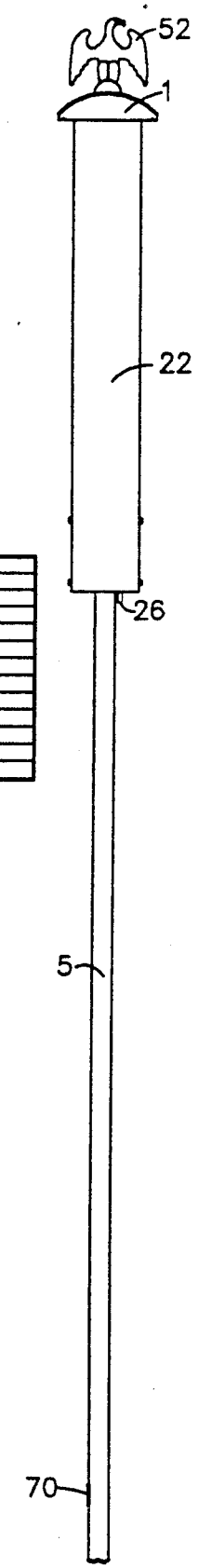
FIG. 16 depicts a view similar to FIGS. 14 and 15 showing the housing mated with the weather cap, the Flag being sheltered within the housing.

Viewing FIGS. 1, 8 and 12, initial pulling upon the line 17 displaces the ring 12 furling the Flag. Continued pulling upon the line hoist the housing 22 along the flagpole, the furled Flag being received, FIG. 12, into the opening 21 at the top of the housing. Continued pulling upon the line will finally mate the housing means with the cap 1, the housing loftily sheltering the Flag, FIG. 16. The line 17 can be manually or mechanically pulled and fed out for the purposes of hoisting and lowering the housing along the flagpole.

Figure 24:
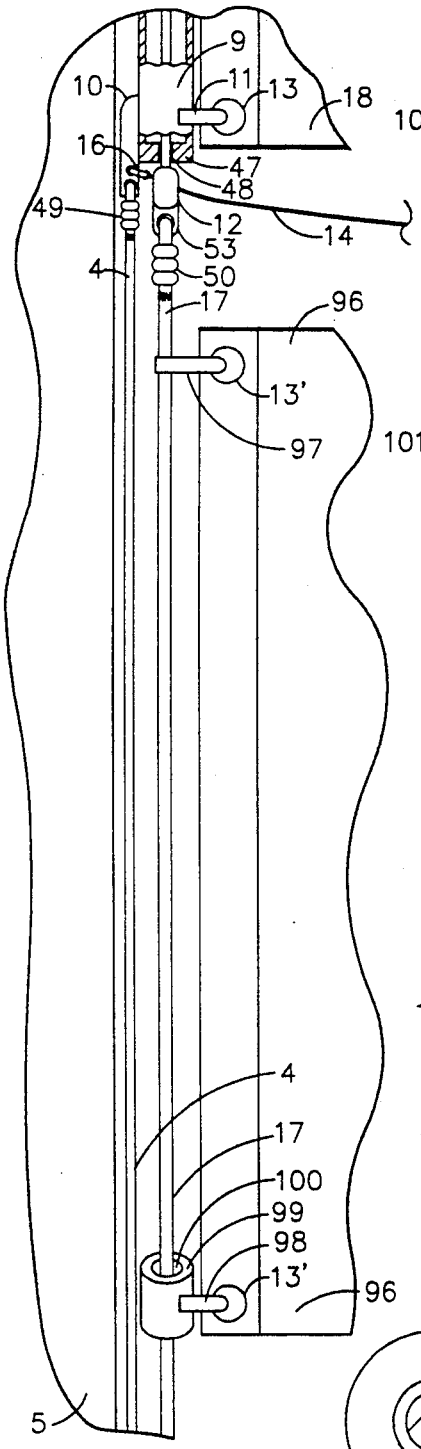
FIG. 24 depicts a view similar to FIGS. 7 and 8 and shows a second flag combined with the invention.
Figure 27:
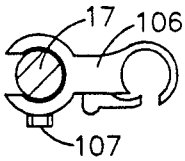
FIG. 27 depicts a view similar to FIG. 26 and shows a type snap hook attached to a flexible line.
Figure 28:
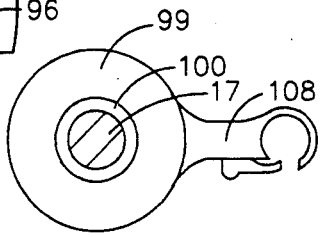
FIG. 28 depicts a view similar to FIG. 26 and 27 and shows a weight having a snap hook attached thereto.
Figure 29:
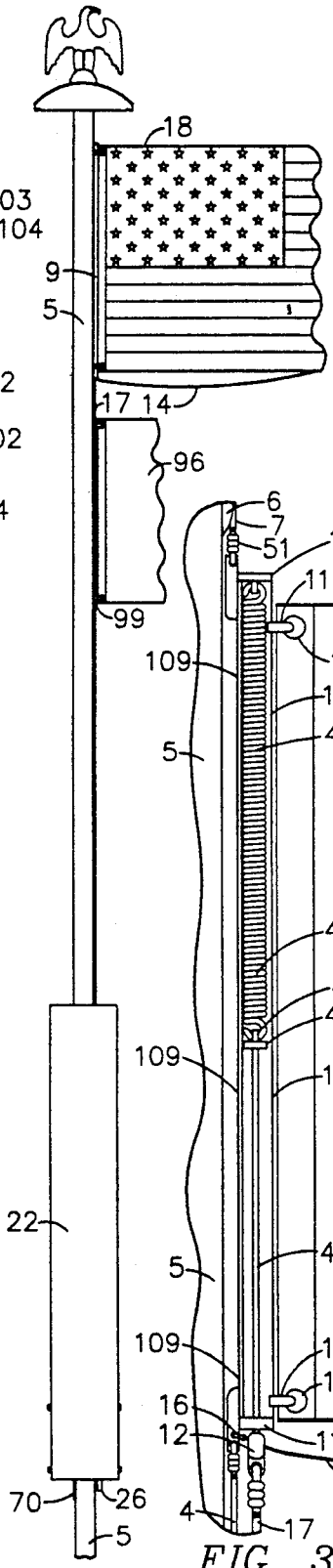
FIG. 29 depicts a view similar to FIGS. 14, 15 and 16, and shows two flags combined with the invention.

Viewing FIGS. 24 and 29, a second flag 96 is shown combined with the invention. Basically, an upper portion of the leading edge of the flag 96 is attached to the line 17 proximate the ring 12 and a lower portion of the leading edge thereof is attached to a weight 99, the weight encircling the line 17. More specifically described, a type snap hook 97 is fastened through the upper opening 13' provided with the second flag. Preferably, the snap hook 97 is similar to the snap hook 106 depicted in FIG. 27. The snap hook 106 partially encircles the line 17 and a set screw 107 secures the snap hook 106 to the line 17. The top corner of the leading edge of the second flag is disposed proximate the lower corner of the leading edge of the Flag 18. Another type snap hook 98 is fastened through the lower opening 13' provided with the second flag. Preferably, the snap hook 98 is similar to the snap hook 108 depicted in FIG. 28. As shown, the snap hook 108 is a member of the weight 99. An aperture 100 for receiving the line 17 is arranged through the weight 99. The weight 99 keeps the leading edge of the second flag 96 stretched and extended downward adjacent the flagpole except when the flags 18, 96 are being received into the top opening 21 of an upward moving housing, FIG. 12. It is preferred, though not necessary, that the second flag 96 will be somewhat smaller that the Flag 18. A person trained in the art could combine additional flags with the apparatus. For example, a third flag could have an upper portion of the leading edge thereof attached to the previously described weight 99 with a lower portion of the leading edge thereof attached to a second weight, the second weight also encircling the line.

Figure 13:
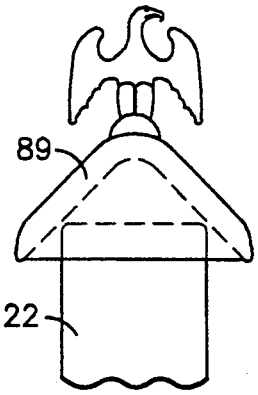
FIG. 13 depicts a plane partial front view of an alternate type weather cap.
Figure 14:
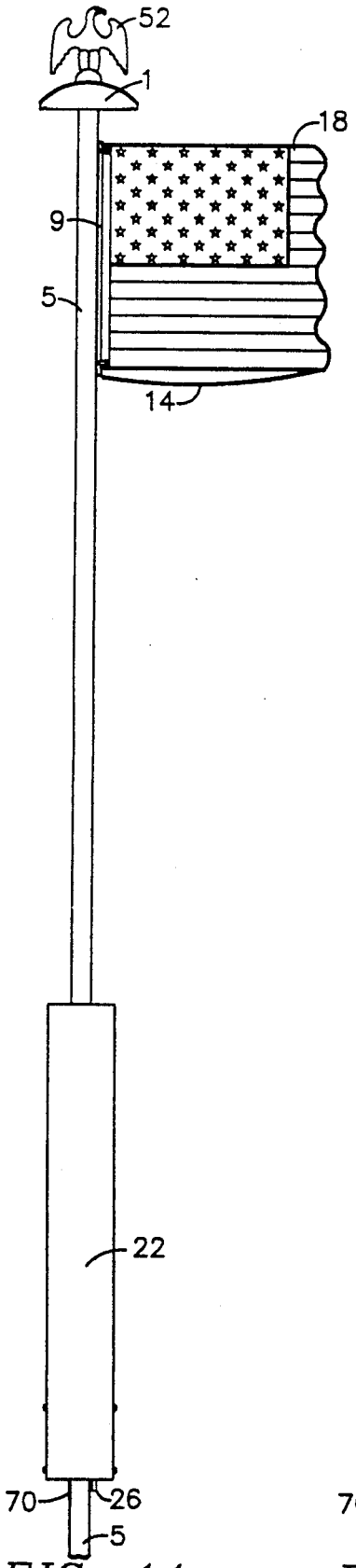
FIG. 14 depicts a plane partial front view of the Flag at full-staff.

Viewing FIG. 13, a substitute weather cap 89 having a concave shaped opening for receiving the top of the housing 22 is shown. Should the housing happen to slightly list relative to the flagpole, the housing means will be forced into alignment with the flagpole as the top thereof enters the concave shaped opening.

Figure 10:
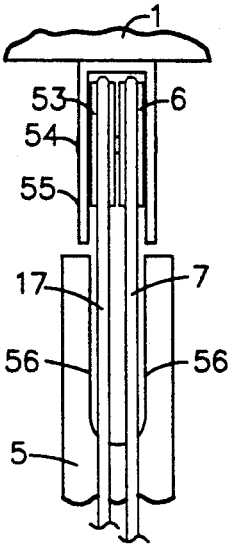
FIG. 10 depicts a view similar to FIG. 5, the view showing a substitute housing line sheave combined with the frame member of the weather cap.

Viewing FIG. 10, a substitute line sheave 53 is combined with the weather cap 1. The pin 54 mounted sheaves 53,6 are disposed juxtaposed within a depending frame member 55 of the weather cap 1. Wider slits 56 for receiving the sheaves are necessarily provided.

Figure 11:
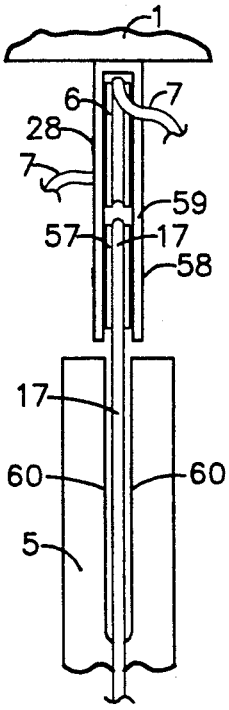
FIG. 11 depicts a view similar to FIGS. 5 and 10, the view showing another substitute housing line sheave combined with the frame member of the weather cap.

Viewing FIG. 11, another substitute line sheave 57 is combined with the weather cap 1. The sheave 57 is pin 58 mounted within a depending frame member 59 of the weather cap 1 such that it is disposed below the halyard sheave 6. Preferably, the diameters of the sheaves 57,6 are such that the halyard 7 and line means 17 are spaced apart, to prevent fraying, when trained about the sheaves. Elongated slits 60 for receiving the sheaves 57,6 are necessarily provided.

If either of the sheaves 53,57 are combined with the weather cap, the hereinbefore described line sheave 19 within the flagpole can be eliminated from the flagpole making the flagpole an ultra simple component of the invention. A person trained in the art could further simplify the flagpole by eliminating the slits at the top thereof. For example, the cap could be modified so that the sheaves associated with the cap are disposed external of the flagpole. At this time it should be mentioned and understood that a person trained in the art could eliminate all of the hereinbefore described sheaves by suitably combining conventional pulleys with the apparatus.

Figure 17:
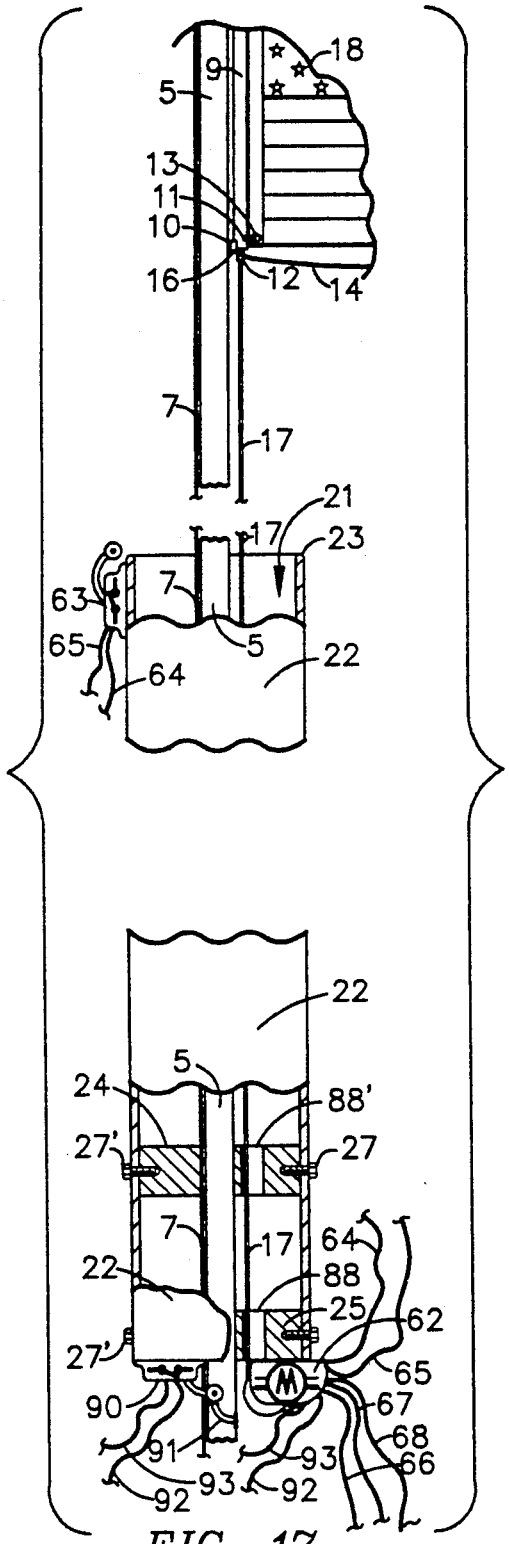
FIG. 17 depicts a plane partial fragmentary cut-away sectional front view of the invention, the invention having a winch and limit switches combined therewith.
Figure 18:
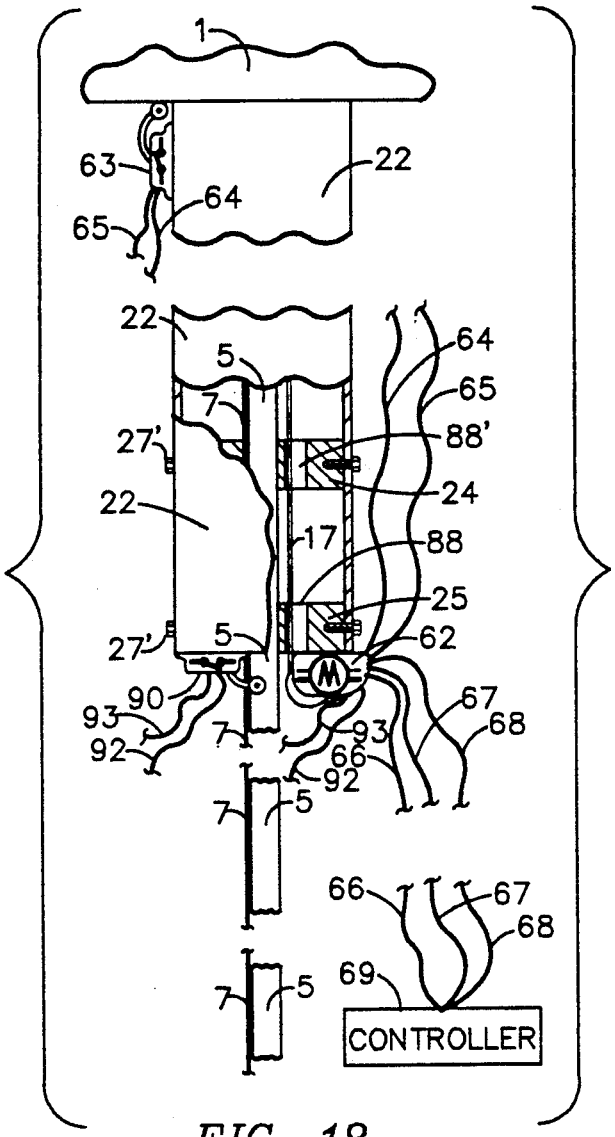
FIG. 18 depicts a view similar to FIG. 17, the view showing basic electrical equipment combined with the invention.

Viewing FIGS. 17 and 18, the line means 17 is shown extending from the hereinbefore described ring tab 53 and attached to a real member of a reversible electrically controlled winch 62, the winch being mounted to the bottom of the flag housing 22. Enlarged apertures 88,88' provide space for the normal oscillation of the line 17 as the line is being reeled in/out via the winch 62. A limit switch 63 stops the upward movement of the housing 22 as the top of the housing mates with the bottom of the weather cap 1. It is preferred that the limit switch 63 will simply open the winch hoisting circuit depicted by the electrical conductors 64,65. Another limit switch 90 is mounted to the bottom of the housing 22 for stopping downward movement of the housing. Again, it is preferred that the limit switch 90 simply open the winch lowering circuit depicted by the electrical conductors 92,93 when the contact arm of the limit switch 90 engages the switch stop 91, the switch stop 91 being fixedly attached upon the flagpole 5. Main winch control circuits, depicted by electrical conductors 66,67,68, are suitably connected between the winch 62 and a winch control station 69. The electrical conductors 64,65,92,93 should and can be neatly routed within or without the flag housing 22 and the conductors 66,67,68 should unravel or stretch out as the housing is hoisted. For example, the conductors 66,67,68 can be contained within a spiral shaped extendable sleeve. The hereinbefore described sheaves 19, 26, 53, 57 associated with the housing line 17 are eliminated from the invention when a winch is combined with the invention. Because of the numerous known methods for controlling a winch, the above electrical descriptions are for illustrative purposes only. Basically, the winch, winch control station, and limit switches provide winching means for reeling in/out the line means.

Figure 25:
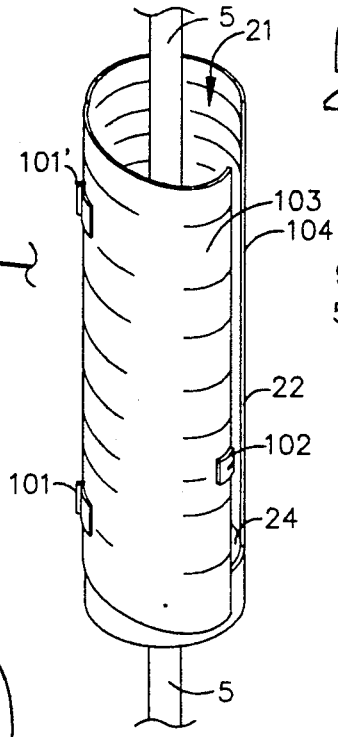
FIG. 25 depicts a perspective view of a flag housing which can be opened and closed.

Viewing FIG. 25, a type flag housing means 22 which can be opened is shown. A suitable portion of the housing means is cut into two preferable symmetric sections 103, 104 and the sections are simply hinged 101,101' together. The latch 102 is for latching and unlatching the hinged sections of the housing means.

Figure 30:
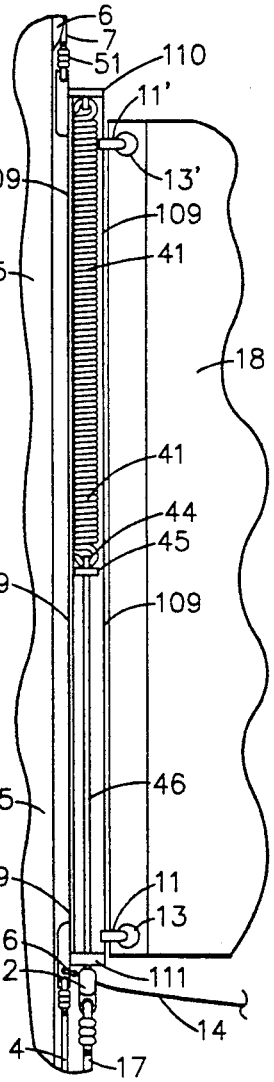
FIG. 30 depicts a view similar to FIGS. 7 and 8, and shows an elongate non tubular shaped mechanism being substituted for the halyard tube.

Viewing FIG. 30, an elongate corrosion resistant mechanism 109 is substituted for the halyard tube 9, the mechanism having a preferred cross section which is similar to the cross section of conventional angle iron. The ends 110,111, spring 41, link stop 45, link 46, ring 12, flag and flag furling cord are combined with the mechanism 109 in a manner suitably similar to that as previously described for the halyard tube. The mechanism 109 is shown for illustrative purposes only. A person skilled in the art could substitute numerous implements for the halyard tube 9 and mechanism 109 described in this specification, the implements being functionally similar to the halyard tube and mechanism.

I prefer that any object, regardless of its shape, which is substituted for my halyard tube will be referred to as a halyard tube.

Viewing FIG. 20, the flagpole is shown base 74 mounted atop a building 76. Conventional type pulleys 73,72,75 are combined with the apparatus so that the halyards 7,4 and line 17, (flexible lines), when suitably trained about the pulleys, can be remotely manipulated. Standard cleats 77,78 are mounted upon the building to provide tie points for the flexible lines.

Viewing FIG. 21, the flagpole is shown base 81 mounted at ground level. Cleats 95,95' are mounted upon the flagpole to provide tie points for the flexible lines 7,4,17. The previously described stop 79 is also a bolt on 80,80' sleeve 79, the sleeve being employed to join, or splice, together two separate sections of a flagpole. The sleeve is shown to justify stating that this invention can be combined with existing flagpoles.

Figure 22:
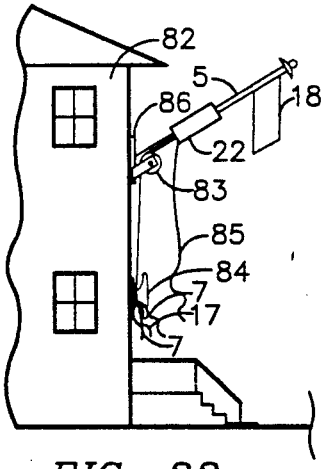
FIG. 22 depicts a view similar to FIGS. 20 and 21 showing the invention mounted high on the front side of a two story building.

Viewing FIG. 22, the inclined flagpole is shown base 86 mounted to the front side of a building 82. The flagpole is mounted out of reach above the first floor of the building. A suitable pulley 83 having the flexible lines trained thereabout is combined with the apparatus so that the flexible lines can be remotely manipulated. A cleat 84 is mounted upon the building to provide a tie point for the flexible lines. An extra hauling line 85 is attached to the bottom of the flag housing 22 so that the housing can be pulled downward along the inclined flagpole should the housing 22 fail to slide down the flagpole under the influence of gravity.

Figure 23:
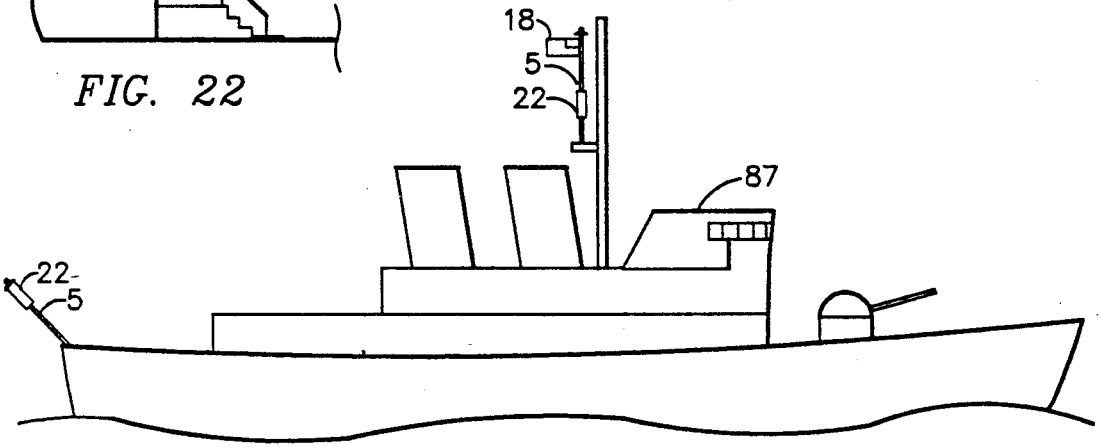
FIG. 23 depicts a plane front view of the invention mounted aloft and astern on a vessel.

Viewing FIG. 23, two of the apparatuses are shown combined with a vessel 87 such that one of the apparatuses is disposed at the stern of the vessel and such that the second apparatus is disposed aloft on the vessel. Although a military vessel is depicted in the drawing, the apparatus can be combined with any suitable vessel.

In light of the above teachings, a person skilled in the art could design, construct, and combine numerous types of flag housings with the described apparatus. For example, a telescoping flag housing could be combined with the apparatus should a more compact housing be desired.

A person skilled in the art could remotely locate a winch for reeling in/out the housing line.

The Flag of the United States of America has been more particularly mentioned in the foregoing specification. However, it is to be understood that the invention can shelter and display other flags, or the like.

The foregoing description of the preferred embodiment of the invention has been presented for the purposes of illustration and description. It is not intended to be exhaustive or to limit the invention to the precise forms disclosed. Many modifications and variations are possible in light of the above teaching. It is intended that the scope of the invention be limited not by this detailed description, but rather by the claim appended hereto.

I claim:

1. An apparatus for displaying and loftly sheltering a flag upon a flagpole comprising:

a) a weather capped flagpole;

b) a halyard tube having the leading edge of a flag attached thereto;

c) a flag furling cord, said cord extending from the midpoint of the lower edge of said flag to a tab member of said halyard tube, said tab member of said halyard tube being disposed proximate the bottom of said halyard tube;

d) a displaceable spring retracted ring member of said halyard tube, said displaceable spring retracted ring member of said halyard tube being disposed proximate the bottom of said halyard tube and encircling said flag furling cord;

e) a spring means for retracting and limiting displacement of said displaceable spring retracted ring member of said halyard tube, said spring means being disposed within said halyard tube;

f) a halyard for hoisting said halyard tube alongside said flagpole, said halyard being attached to said halyard tube;

g) a flag housing, said flag housing surroundingly enveloping a length of said flagpole;

h) a hoisting and lowering line for hoisting and lowering said flag housing along said flagpole, said hoisting and lowering line being attached to said displaceable spring retracted ring member of said halyard tube; and i) wherein initial pulling upon said line displaces said displaceable spring retracted ring member of said halyard tube furling said flag, continued pulling upon said line hoisting said flag housing along said flagpole, said furled flag being received into a top opening of said housing, said housing mating with the cap of said weather capped flagpole.

2. The apparatus of claim 1 further comprising a second flag, said second flag having an upper portion of the leading edge thereof attached to said line and having a lower portion of the leading edge thereof attached to a weight, said weight encircling said line.

3. The apparatus of claim 1 further comprising an electrically controlled winch for reeling in/out said line, said winch being mounted to the bottom of said flag housing.

4. The apparatus of claim 1 wherein said spring means for retracting and limiting displacement of said displaceable spring retracted ring member of said halyard tube comprises:

a) a link stop, said link stop being disposed within said halyard tube;

b) a spring, said spring having a lower hook formed end thereof hooked onto an upward protruding tab member of said link stop and having an upper hook formed end thereof hooked onto a depending tab member of a halyard tube cover plate;

c) an elongated link, said link depending from said link stop and being slidingly disposed through an aperture arranged through a bottom plate member of said halyard tube, said displaceable spring retracted ring member of said halyard tube depending from said link; and d) wherein said link stop comes into contact with said bottom plate member of said halyard tube when said displaceable spring retracted ring member of said halyard tube is displaced, said spring being stretched.

5. An apparatus for displaying and loftily sheltering a flag upon a flagpole comprising:

a) a flagpole;

b) a halyard tube having a flag attached thereto;

c) a flag furling cord, said cord extending from said flag to said halyard tube;

d) a ring encircling said cord, said ring being disposed below said halyard tube;

e) a spring means for retracting and limiting displacement of said ring, said spring means being disposed within said halyard tube;

f) a halyard for hoisting said halyard tube alongside said flagpole, said halyard being attached to said halyard tube;

g) a flag housing means for sheltering said flag, said housing means surroundingly enveloping a length of said flagpole;

h) a hoisting and lowering line means for hoisting and lowering said housing means along said flagpole, said line means being attached to said ring; and i) wherein initial pulling upon said line means displaces said ring furling said flag, continued pulling upon said line means hoisting said housing means along said flagpole, said furled flag being received into a top opening of said housing means, said housing means mating with a weather cap disposed atop said flagpole.

6. The apparatus of claim 5 further comprising a second flag, said second flag having an upper portion of the leading edge thereof attached to said line means and having a lower portion of the leading edge thereof attached to a weight, said weight encircling said line means.

7. The apparatus of claim 5 further comprising a winch for reeling in/out said line means, said winch being mounted to said housing means.

8. The apparatus of claim 5 wherein said spring means for retracting and limiting displacement of said ring comprises:

a) a link stop, said link stop being disposed within said halyard tube;

b) a spring, said spring having a lower hook formed end thereof hooked onto a tab member of said link stop and having an upper hook formed end thereof hooked onto a tab member of a halyard tube cover plate;

c) an elongated link, said link depending from said link stop and being slidingly disposed through an aperture arranged through a bottom plate member of said halyard tube, said ring depending from said link; and d) wherein said link stop comes into contact with said bottom plate member of said halyard tube when said ring is displaced, said spring being stretched.

9. An apparatus for displaying and loftily sheltering a flag upon a flagpole comprising: a tube; a flag being attached to said tube; a cord extending from said flag to said tube; a displaceable ring encircling said cord; a spring means for retracting said ring being disposed within said tube; a halyard being attached to said tube for hoisting said tube alongside a flagpole; a housing means for sheltering said flag surroundingly enveloping a length of said flagpole; a line means for hoisting said housing means along said flagpole being attached to said ring; and wherein initial pulling upon said line means displaces said ring furling said flag, continued pulling upon said line means hoisting said housing means along said flagpole, said furled flag being received into a top opening of said housing means, said housing means mating with a weather cap disposed atop said flagpole.

10. The apparatus of claim 9 further comprising a second flag having an upper portion of the leading edge thereof attached to said line means and having a lower portion of the leading edge thereof attached to a weight, said weight encircling said line means.

11. The apparatus of claim 9 further comprising winching means for reeling in/out said line means, said winching means being mounted to said housing means.

12. The apparatus of claim 9 wherein said spring means comprises: a stop disposed within said tube; a spring being attached to said stop and a tube cover plate; a link depending from said stop and being disposed through an aperture arranged through a bottom plate member of said tube; said ring depending from said link; and wherein said stop bottoms out within said tube when said ring is displaced; said spring being stretched.

* * * * *